US006550358B1

(12) United States Patent
Martin

(10) Patent No.: US 6,550,358 B1
(45) Date of Patent: Apr. 22, 2003

(54) HEXAGONAL WRENCH SOCKET ADAPTER

(76) Inventor: Billy C. Martin, 161 Jackson Rd., New Hope, AL (US) 35760

( * ) Notice: Subject to any disclaimer, the term of this patent is extended or adjusted under 35 U.S.C. 154(b) by 0 days.

(21) Appl. No.: 10/178,430

(22) Filed: Jun. 24, 2002

(51) Int. Cl.[7] ..... B25G 1/04
(52) U.S. Cl. ..... 81/177.2; 81/438; 81/180.1
(58) Field of Search ..... 81/177.1, 177.2, 81/438, 180.1

(56) References Cited

U.S. PATENT DOCUMENTS

| | | | |
|---|---|---|---|
| 2,810,472 | A | 10/1957 | Midkiff |
| 3,997,053 | A | 12/1976 | Bondhus |
| 4,101,025 | A | 7/1978 | Jordan |
| 4,750,750 | A | 6/1988 | Batalorf, Jr. |
| 4,767,006 | A | 8/1988 | Wasem |
| 4,982,632 | A | 1/1991 | Barmore |
| 5,287,775 | A | 2/1994 | Moore |
| 5,394,984 | A | 3/1995 | Aiba |
| D373,943 | S | 9/1996 | Fuhrmann |
| D415,403 | S | 10/1999 | Sterpka et al. |
| 5,992,625 | A | 11/1999 | Loiselle |
| 6,092,441 | A | 7/2000 | Jarvis |
| D433,613 | S | 11/2000 | Jialin |

*Primary Examiner*—James G. Smith
*Assistant Examiner*—Hadi Shakeri
(74) *Attorney, Agent, or Firm*—John D. Gugliotta; Olen L. York, III

(57) ABSTRACT

An apparatus is provided that allows the use of a standard ratchet wrench on the "L" shaped Allen wrenches. With a square drive on one end, the end which normally goes over a bolt or nut has a slotted design which fits over the "L" shaped end of an Allen wrench. The invention then provides increased leverage and control to remove or tighten stubborn Allen bolts and also protects the user's hands from sudden slippage and associated rapped knuckles.

2 Claims, 3 Drawing Sheets

HEXAGONAL WRENCH SOCKET ADAPTER

RELATED APPLICATIONS

The present invention was first described in Disclosure Document Number 495,255 filed on Jun. 18, 2001 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to socket wrenches and hexagonal wrenches and, more particularly, to an hexagonal wrench socket adapter.

2. Description of the Related Art

As anyone who performs a lot of mechanical work will attest, nothing beats having the proper tool for a job. The proper tool can save time, save money, produce a higher quality job, reduce damage to equipment, and provide for the increased safety of the worker. One tool that is found in many lines of work is that of the Allen wrench. These "L" shaped wrenches are used on Allen bolts to remove or tighten them. Their design however is prone to several problems. First, they are held in one's hand, making their applications limited in confined areas where one cannot get their hand. Secondly, their short handle length makes it difficult to apply even a moderate amount of leverage to remove or tighten stubborn Allen bolts.

Numerous attempts have been made to correct for the foregoing. A search of the prior art did not disclose any patents that read directly on the claims of the instant invention; however, the following references were considered related:

| U.S. Pat. No. | Inventor | Issue Date |
|---|---|---|
| 6,092,441 | Jarvis | Jul. 25, 2000 |
| 5,992,625 | Loiselle | Nov. 30, 1999 |
| 5,394,984 | Aiba | Mar. 7, 1995 |
| 5,287,775 | Moore | Feb. 22, 1994 |
| 4,892,632 | Barmore | Jan. 8, 1991 |
| 4,767,006 | Wasem | Aug. 30, 1988 |
| 4,750,750 | Batalorf, Jr. | Jun. 14, 1988 |
| 4,101,025 | Jordan | Jul. 18, 1978 |
| 3,997,053 | Bondhus | Dec. 14, 1976 |
| 2,810,472 | Midkiff | Jul. 20, 1956 |
| D 433,613 | Jialin | Nov. 14, 2000 |
| D 415,403 | Sterpka et al | Oct. 19, 1999 |
| D 373,943 | Fehrman | Sep. 24, 1996 |

Consequently, a need has been felt for providing a socket adapter for connection to a hexagonal wrench in a manner that provides for increased leverage and torque, works in tight spaces, and can be used with any tool with a square socket connection.

SUMMARY OF THE INVENTION

It is therefore an object of the present invention to provide an improved socket wrench adapter.

It is a feature of the present invention to provide an improved hexagonal wrench socket adapter.

Briefly described according to one embodiment of the present invention, an apparatus is provided that allows the use of a standard ratchet wrench on the "L" shaped Allen wrenches. With a square drive on one end, the end which normally goes over a bolt or nut has a slotted design which fits over the "L" shaped end of an Allen wrench. The invention then provides increased leverage and control to remove or tighten stubborn Allen bolts and also protects the user's hands from sudden slippage and associated rapped knuckles.

An advantage of the present invention is that it allows use of an Allen wrench in confined quarters where it is difficult or impossible to get one's hand on the wrench.

The use of the present invention further provides users of Allen wrenches an extra leverage of power and torque in tight locations in a manner which is not only quick, easy and effective, but safe as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
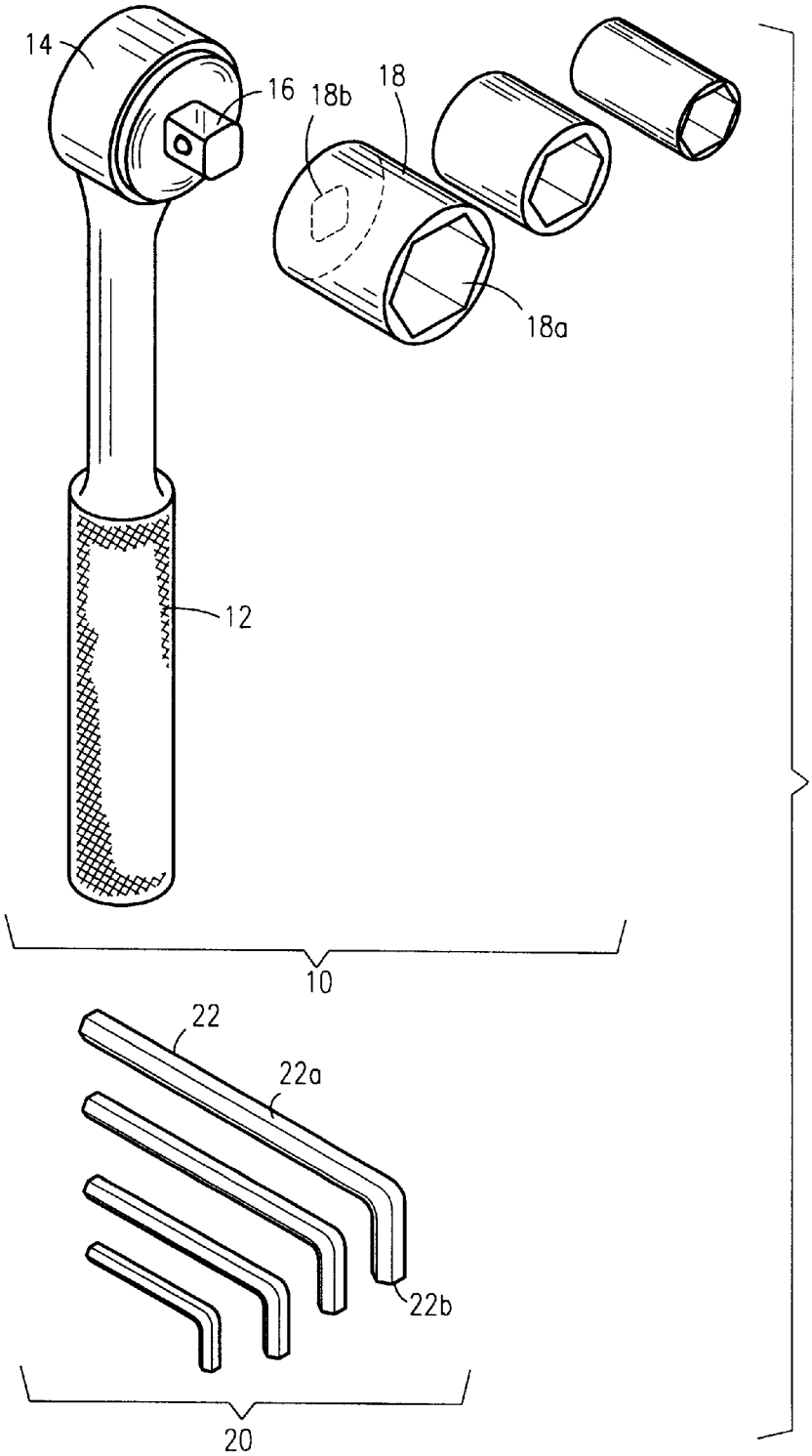
Fig. 1 PRIOR ART
FIG. 1 is a perspective view of a ratchet wrench and a hexagonal wrench according to the PRIOR ART.

In order to describe the complete relationship of the invention, it is essential that some description be given to the manner and practice of functional utility and description of the PRIOR ART, as shown in conjunction with FIG. 1. An otherwise conventional ratchet wrench 10 is generally available having an elongated handle 12 extending radially from a rotating head 14. The rotating head 14 supports an attachment protuberance 16 that removably affixes to a socket 18 selected from a plurality of such units. Each socket 18 includes a recess or cavity 18*a* adapted to receive a specific size nut or bolt head. All sockets 18 include an attachment recess 18*b* of a common size that allows receiving of the attachment protuberance 16 for purposes of providing a rotational driving torque to the nut or bolt head.

Additionally, an otherwise conventional set of hexagonal wrenches 20 incorporate a series of individual wrenches 22, each of which are bent so as to be of letter "L" configuration comprising relatively long shafts 22*a* having hexagonal sections and relatively short operating portions 22*b*. Each of the set is each provided with a different diameter.

Figure 2:
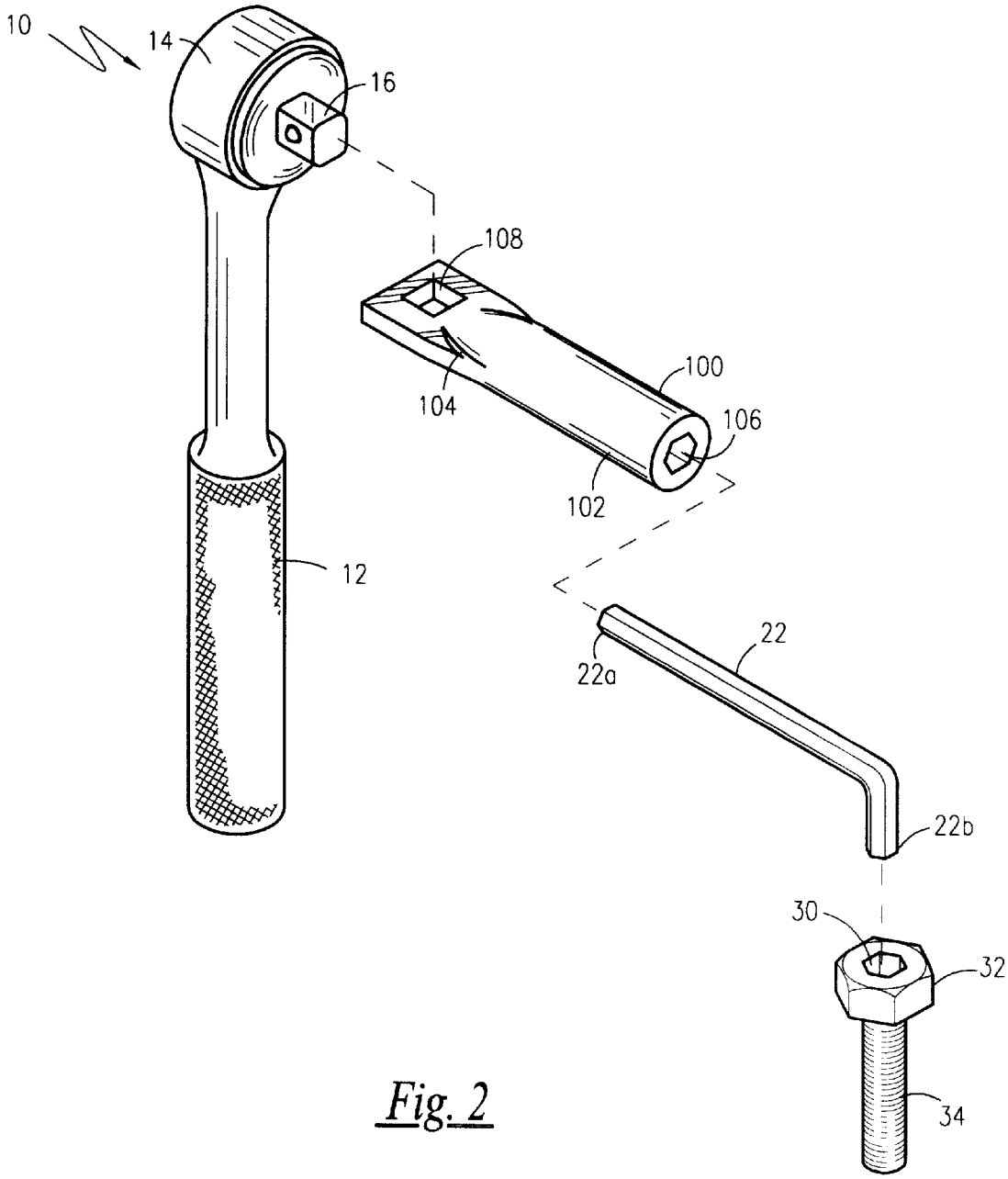
FIG. 2 is am exploded perspective view of a hexagonal wrench socket adapter according to the preferred embodiment of the present invention.
Figure 3:
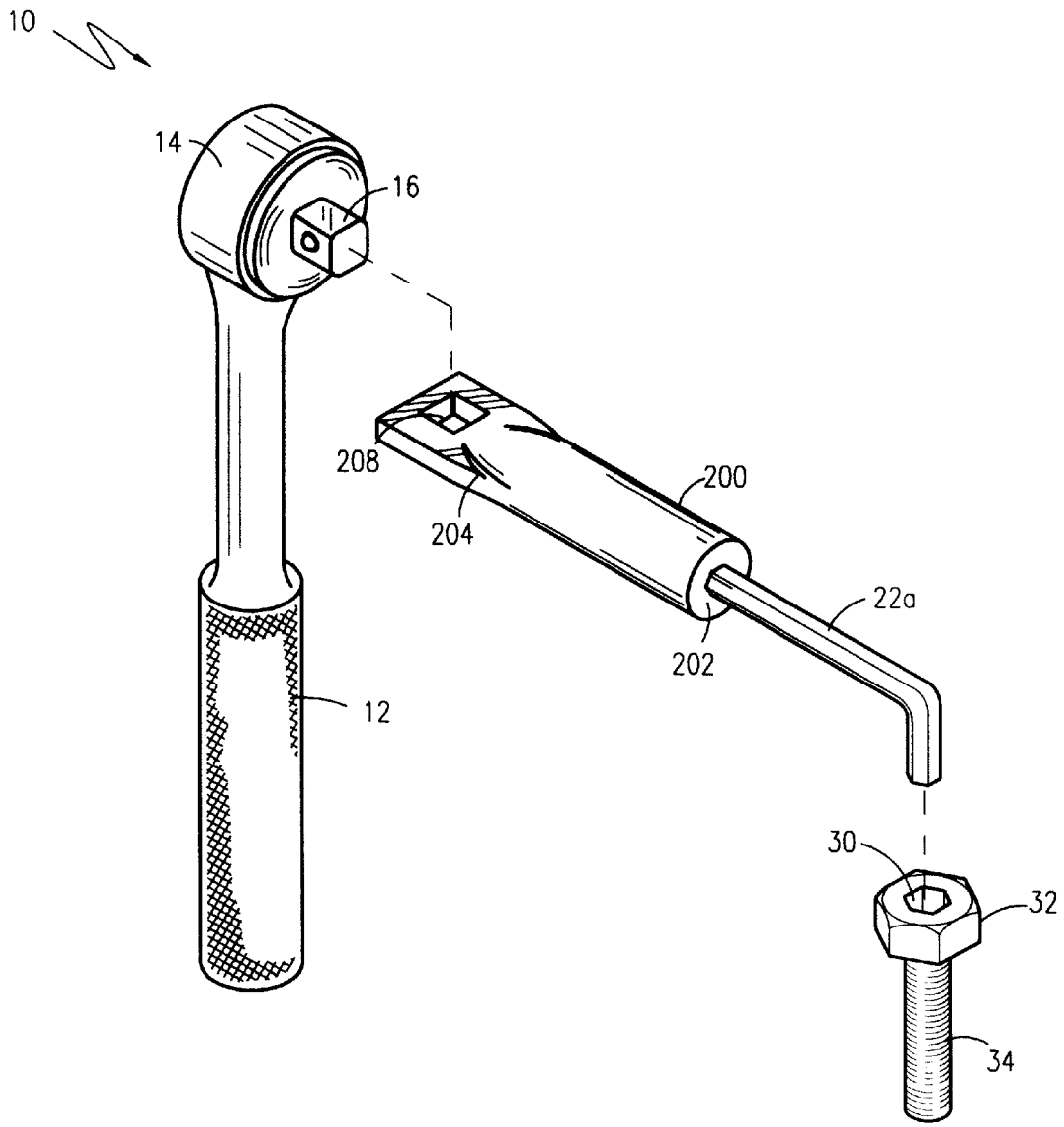
FIG. 3 is an exploded.perspective view of an alternate embodiment thereof.

The best mode for carrying out the invention is presented in terms of its preferred embodiment, herein depicted within the FIGS. 2–3.

1. Detailed Description of the Figures

Referring now to FIG. 2, an hexagonal wrench socket adapter 100 is shown, according to the present invention, for use with an otherwise conventional ratchet wrench 10. The adapter 100 has a linearly elongated outer housing having a first end 102 opposite a second end 104. The first end 102 is a cylindrical outer surface forming a hexagonal receiving cavity 106 for receiving a specific long shaft 22*a* of a hexagonal wrench 22, and is deep enough to receive a significant portion, i.e. more than half, of the linear length of the long shaft 22*a*. The second end 104 is a horizontally planar surface. The second end 104 forms a block protuberance receiving cavity 108. The block protuberance receiving cavity 108 is of a common size that allows receiving of the attachment protuberance 16 for purposes of providing a rotational driving torque to the hexagonal wrench 22. The block protuberance receiving cavity 108 is aligned perpendicular to the horizontal planar surface and the hexagonal receiving cavity 106 at the first end 102.

Referring now to FIG. 3, an alternate embodiment for a hexagonal wrench socket adapter 200 is shown, wherein a linearly elongated outer housing is provided having a first end 202 opposite a second end 204. The first end 202 is a cylindrical outer surface rigidly and mechanically affixed to a specific long shaft 22*a* of a hexagonal wrench 22. The second end 204 is a horizontally planar surface. The second end 204 forms a block protuberance receiving cavity 208. The block protuberance receiving cavity 208 is of a common size that allows receiving of the attachment protuberance 16 for purposes of providing a rotational driving torque to the hexagonal wrench 22. The block protuberance receiving cavity 208 is aligned perpendicular to the horizontal planer surface and the long shaft 22*a* of the hexagonal wrench 22.

2. Operation of the Preferred Embodiment

To use the present invention in accordance with either embodiment, the adapter is placed upon a ratchet wrench and the relatively short operating portions 22*b* is engaged with a bolt head wrench receiving cavity 30 formed in the bolt head 32 of an otherwise conventional hex bolt 34. In accordance with a preferred embodiment of the present invention, variable geometric leverage can be accomplished in many planes and at various rates and in various limited access situations.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A hexagonal wrench socket adapter for use with a ratchet wrench, said adapter comprising:

a linearly, elongated outer housing terminating at two opposing ends;

a first end said first end formed at a terminal end of said outer housing, said first end having a cylindrical outer surface;

a hexagonal receiving cavity formed in said first end and receives a long shaft of a hexagonal wrench;

a second end, said second end formed at a terminal end opposite said first end, said second end having a horizontally planar surface; and a block protuberance receiving cavity formed in said second end, said block protuberance receiving cavity having a central axis, said axis being perpendicular to said planar surface and said hexagonal receiving cavity, said block protuberance receiving cavity is of a size that allows receipt of an attachment protuberance of said ratchet wrench for purposes of providing a rotational driving torque to the hexagonal wrench.

2. A hexagonal wrench socket adapter comprising:

a linearly elongated outer housing terminating at two opposing ends;

a first end, said first end formed at a terminal end of said outer housing, said first end having a cylindrical outer surface;

a long shaft of a hexagonal wrench rigidly and mechanically affixed to said first end;

a second end, said second end formed at a terminal end opposite to said first end, said second end having a horizontally planar surface; and a block protuberance receiving cavity formed in said second end, said block protuberance receiving cavity having a central axis, said axis being perpendicular to said planar surface and said hexagonal long shaft said block protuberance receiving cavity is of a size that allows receipt of an attachment protuberance of a ratchet wrench for purposes of providing a rotational driving torque to the hexagonal wrench.

* * * * *